US011104175B1

(12) United States Patent
Taguchi et al.

(10) Patent No.: US 11,104,175 B1
(45) Date of Patent: Aug. 31, 2021

(54) SHEET PROCESSING APPARATUS, IMAGE FORMING SYSTEM, AND SHEET PROCESSING METHOD

(71) Applicant: TOSHIBA TEC KABUSHIKI KAISHA, Tokyo (JP)

(72) Inventors: Hiroyuki Taguchi, Tagata Shizuoka (JP); Shoichi Dobashi, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/829,542

(22) Filed: Mar. 25, 2020

(51) Int. Cl.
*B42C 1/12* (2006.01)
*B65H 33/08* (2006.01)
*B65H 7/20* (2006.01)

(52) U.S. Cl.
CPC ..... *B42C 1/12* (2013.01); *B65H 7/20* (2013.01); *B65H 33/08* (2013.01); *B65H 2301/1635* (2013.01); *B65H 2408/12* (2013.01); *B65H 2801/06* (2013.01)

(58) Field of Classification Search
CPC .. B42C 1/12; B65H 7/20; B65H 37/04; B65H 33/08; B65H 2301/1635; B65H 2408/122; B65H 2408/1222; B65H 2801/06; B65H 2801/27
USPC ..... 270/58.08, 58.09
See application file for complete search history.

(56) References Cited

U.S. PATENT DOCUMENTS

| | | | | |
|---|---|---|---|---|
| 5,330,170 | A | 7/1994 | Uotani et al. | |
| 6,047,960 | A | 4/2000 | Kawano et al. | |
| 7,445,203 | B2 * | 11/2008 | Kaneko | B42B 4/00 270/58.07 |
| 7,866,650 | B2 * | 1/2011 | Nomura | B65H 31/3081 270/58.12 |
| 2007/0063411 | A1 | 3/2007 | Hirano | |

* cited by examiner

*Primary Examiner* — Leslie A Nicholson, III
(74) *Attorney, Agent, or Firm* — Foley & Lardner LLP

(57) ABSTRACT

A sheet processing apparatus includes a stapler, a translating actuator, a rotating actuator, and a controller. The stapler is configured to bind a plurality of sheets together. The translating actuator is configured to translate the stapler. The rotating actuator is coupled to the translating actuator and configured to rotate the stapler. The controller is configured to (a) receive an instruction input, (b) determine a target position and a target angle of the stapler based on the instruction input, (c) control the translating actuator to move the stapler to the target position, (d) control the rotating actuator to rotate the stapler to the target angle, and (e) control the stapler to bind the plurality of sheets together while the stapler is at the target position and the target angle.

18 Claims, 9 Drawing Sheets

SHEET PROCESSING APPARATUS, IMAGE FORMING SYSTEM, AND SHEET PROCESSING METHOD

FIELD

Embodiments described herein relate generally to a sheet processing apparatus, an image forming system, and a sheet processing method.

BACKGROUND

In the related art, a sheet post-processing apparatus that performs post-processing on a sheet printed in an image forming apparatus has a manual stapling function. The manual stapling function is a function capable of manually performing binding of a sheet bundle. However, in certain scenarios, the manual stapling function of the related art may be inconvenient because the binding can be performed only at one fixed position. Such a situation is not limited to the manual stapling, but also occurs when the sheet post-processing apparatus directly receives the printed sheet from the image forming apparatus and performs post-processing.

DETAILED DESCRIPTION

In general, according to one embodiment, a sheet processing apparatus (e.g., a sheet post-processing apparatus) includes a stapler, a moving mechanism, a rotating mechanism, and a control unit. The stapler is capable of binding a plurality of sheets. The moving mechanism is capable of moving the position of the stapler. The rotating mechanism is provided on the moving mechanism, and capable of adjusting the angle of the stapler by rotating. The control unit moves the stapler by the moving mechanism and adjusts the angle of the stapler by the rotating mechanism so as to perform the binding at a position and an angle corresponding to an instruction input from the outside (e.g., by a user).

Figure 1:
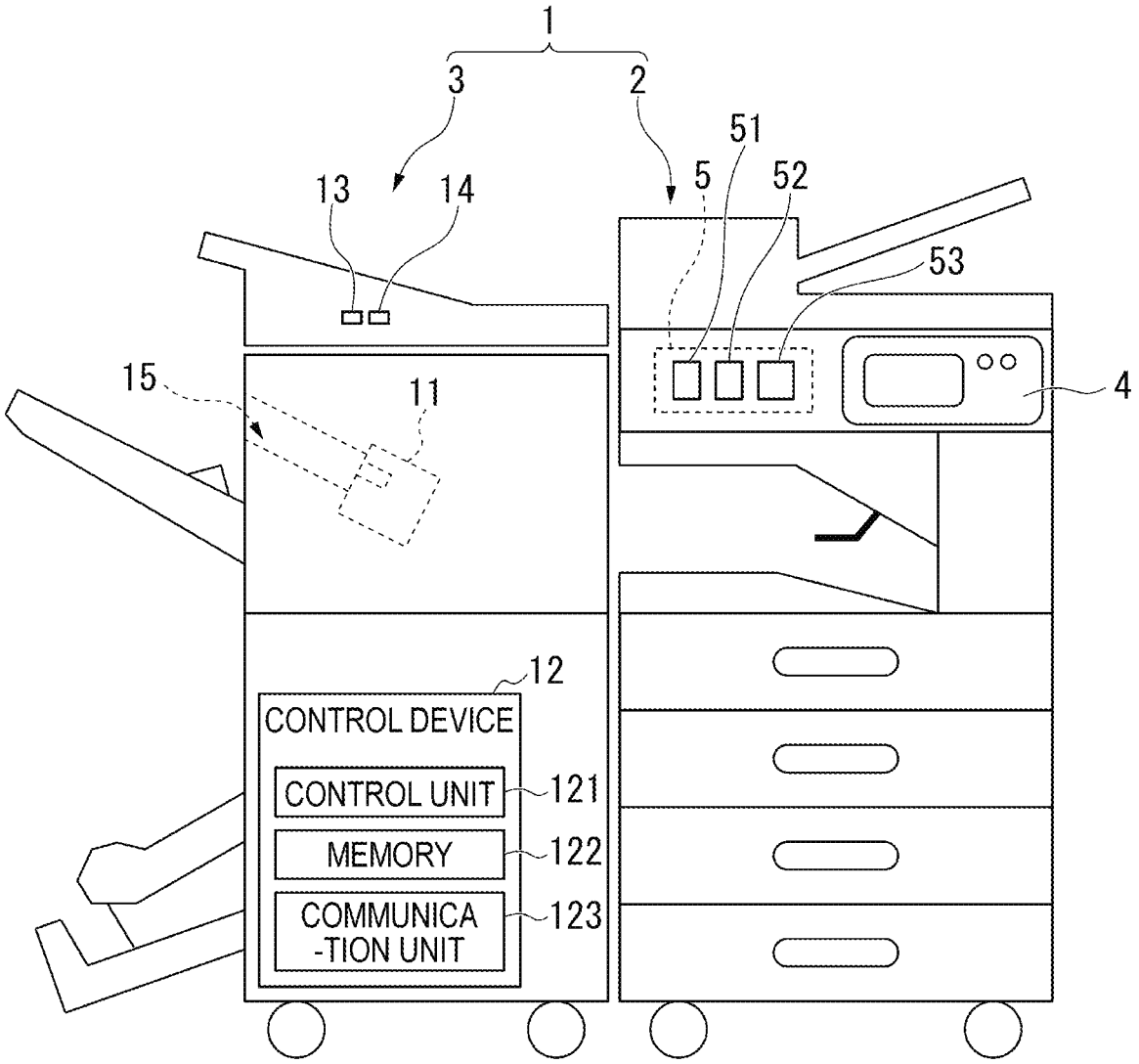
FIG. 1 is a schematic diagram illustrating an example of a hardware configuration of an image forming system according to an embodiment.

Hereinafter, the sheet processing apparatus (e.g., the sheet post-processing apparatus), an image forming system, and a sheet processing method (e.g., a sheet post-processing method) according to the embodiment will be described with reference to drawings. FIG. 1 is a schematic diagram illustrating an example of a hardware configuration of an image forming system 1 according to the embodiment. The image forming system 1 includes an image forming apparatus 2 and a sheet post-processing apparatus 3. The image forming apparatus 2 is a multi-function peripheral (MFP). The image forming apparatus 2 executes image forming and image fixing. The image forming is processing for forming an image on a sheet. The image formed on the sheet may be a toner image or an image formed by ink jet. The image fixing is processing for fixing the image formed on the sheet on the sheet. The sheet, for example, is a recording medium such as paper on which characters or images are formed. The sheet may be any material as long as the image forming apparatus 2 can form an image thereon. The image forming apparatus 2 discharges the sheet to the sheet post-processing apparatus 3 when an instruction to execute processing (e.g., post-processing) is given.

The sheet post-processing apparatus 3 performs binding on a sheet conveyed from the image forming apparatus 2 or a manually inserted sheet. The binding is a process for stacking and aligning a plurality of sheets in a bundle and combining the sheets into one bundle (e.g., by coupling the sheets together) by a binding unit such as a stapler. The sheet post-processing apparatus 3 can execute post-processing other than the binding on the sheet conveyed from the image forming apparatus 2. Post-processing other than the binding includes, for example, aligning, folding, punching, stamping, discharging, and the like. The sheet post-processing apparatus 3 can execute binding on a sheet manually inserted by a manual stapling function. The manual stapling function is a function capable of manual binding. That is, the sheet post-processing apparatus 3 can perform the binding automatically and manually.

Next, specific configurations of the image forming apparatus 2 and the sheet post-processing apparatus 3 will be described. The image forming apparatus 2 includes at least a control panel 4 and a control device 5. The image forming apparatus 2 includes a scanner unit (e.g., a scanner), a printer unit (e.g., a printer), a sheet feeding unit (e.g., a sheet feeding actuator, a sheet feeding tray, etc.), and a sheet discharge unit in addition to the illustrated functional units.

The control panel 4 (e.g., a user interface) includes a display unit and an operation unit. The display unit is a display device such as a liquid crystal display and an organic electro luminescence (EL) display. The display unit displays various pieces of information on the image forming apparatus 2 in accordance with the control of the control device 5. The operation unit includes a plurality of buttons. The operation unit receives a user operation (e.g., a user input). For example, the operation unit receives an instruction to execute printing and an input of information on binding (e.g., binding information, binding data, binding instructions, etc.). The information on the binding is information for specifying a binding point, a binding angle, and a binding position of the binding. That is, on the control panel 4, the number of binding points, the binding angle, and the binding position of the binding can be specified. The operation unit outputs a signal corresponding to the operation performed by the user to the control device 5. The display unit and the operation unit may be configured as an integrated touch panel.

Figure 2:
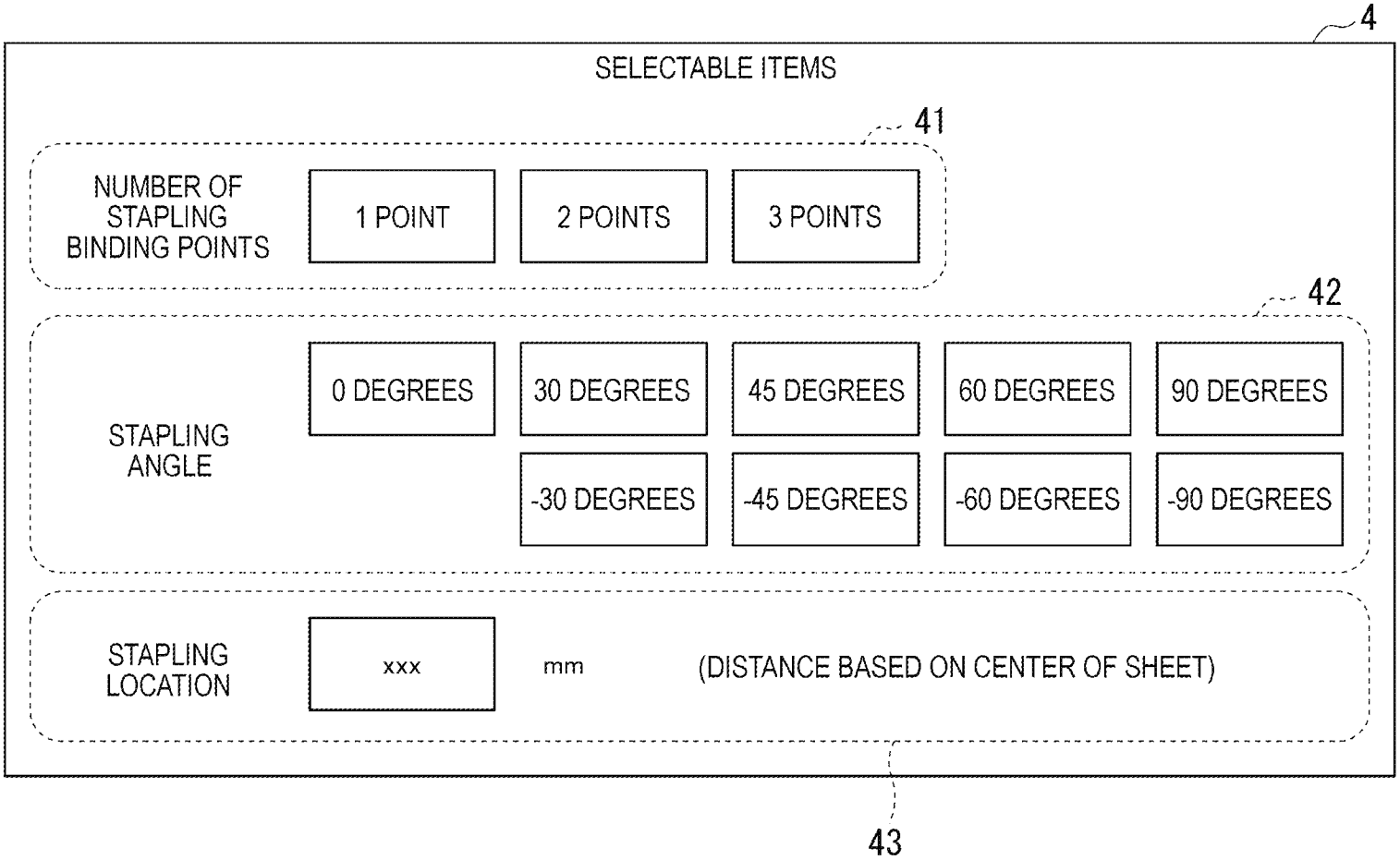
FIG. 2 is a diagram illustrating an example of information that can be specified on a control panel of the embodiment.

FIG. 2 is a diagram illustrating an example of information that can be specified on the control panel 4. As illustrated in FIG. 2, the control panel 4 displays a number-of-binding-points selection area 41, a binding angle selection area 42, and a binding position selection area 43. The information illustrated in FIG. 2 is displayed on the control panel 4 when the user operates the control panel 4 to gives an instruction to input information on the binding (e.g., an instruction input, a user input). The number-of-binding-points selection area 41 displays information for selecting the number of binding points at which sheets are to be bound by the stapler. In the example illustrated in FIG. 2, in the number-of-binding-points selection area 41, three options of "1 point", "2 points", and "3 points" are selectably displayed as the number of stapling binding points. The number of binding points is not limited thereto and may be three or more.

The binding angle selection area 42 displays information for selecting an angle at which sheets are to be bound by the stapler. In the example illustrated in FIG. 2, in the binding angle selection area 42, "0 degrees", "±30 degrees", "±45 degrees", "±60 degrees", and "±90 degrees" are selectably displayed as binding angles (e.g., staple angles). The displayed binding angles are not limited thereto and may be any angle as long as the binding angle is rotatable. For example, the binding angle may be any angle as long as the binding angle is 90 degrees or less.

In the binding position selection area 43, information for selecting a stapling position is displayed. In the example illustrated in FIG. 2, in the binding position selection area 43, a distance based on the center of the sheet is displayed as a stapling position so as to be specifiable. The user selects a desired content from the information illustrated in FIG. 2.

Referring back to FIG. 1, description continues. The control device 5 includes a control unit 51 (e.g., a controller), a memory 52, and a communication unit 53. The control unit 51 is, for example, a processor such as a central processing unit (CPU) or a graphics processing unit (GPU). The control unit 51 controls the operation of each functional unit of the image forming apparatus 2. The control unit 51 executes various kinds of processing by loading and executing a program stored in a read only memory (ROM) in a random access memory (RAM). An application specific integrated circuit (ASIC) may have an appropriate function realized by the control unit 51. The ASIC is a dedicated circuit for realizing a specific function.

For example, the control unit 51 controls the communication unit 53 to notify the sheet post-processing apparatus 3 of an instruction input via the control panel 4. The memory 52 is a memory for temporarily storing data used by each functional unit included in the image forming apparatus 2. The memory 52 is, for example, a RAM. The communication unit 53 is a communication interface for transmitting and receiving data to and from an external apparatus. The communication unit 53 communicates with the sheet post-processing apparatus 3, for example. The communication unit 53 transmits information on the binding (hereinafter, referred to as "binding information") to the sheet post-processing apparatus 3.

The scanner unit reads an image to be read on a document based on brightness and darkness of light. For example, the scanner unit reads an image printed on a sheet to be read set on a document reading table. The scanner unit records the read image information. The recorded image information may be transmitted to another information processing apparatus via a network. The recorded image information may be formed on the sheet as an image by the printer unit 7 as print data.

The printer unit executes image forming and image fixing. For example, the printer unit forms an image on a sheet based on the image information generated by the scanner unit or the image information received via a communication path. The printer unit applies heat and pressure to the image formed on the sheet to fix the image on the sheet.

The sheet feeding unit supplies sheets to the printer unit one by one at the time when the printer unit forms an image. The sheet discharge unit discharges a sheet discharged from the printer unit to the sheet discharge unit or the sheet post-processing apparatus 3. For example, when an instruction to execute post-processing is input to the image forming apparatus 2, the sheet discharge unit discharges the sheet to the sheet post-processing apparatus 3. On the other hand, when an instruction to execute post-processing is not input to the image forming apparatus 2, the sheet discharge unit discharges the sheet to the sheet discharge unit.

Next, the configuration of the sheet post-processing apparatus 3 will be described. As illustrated in FIG. 1, the sheet post-processing apparatus 3 is positioned at a location adjacent to the image forming apparatus 2. The sheet post-processing apparatus 3 performs post-processing on a sheet conveyed from the image forming apparatus 2 or a sheet inserted from outside.

The sheet post-processing apparatus 3 includes a stapler 11, a control device 12 (e.g., a controller), a position selection button 13, and an execution button 14. The stapler 11 is a binding unit capable of binding a plurality of sheets. The stapler 11 in the present embodiment is capable of being moved to a position desired by the user (e.g., a target position) and capable of changing the orientation thereof in the horizontal direction (e.g., in a horizontal plane). When the sheet post-processing apparatus 3 performs the binding by the manual stapling function, the stapler 11 performs the binding on the sheet inserted into an opening 15.

The control device 12 includes a control unit 121 (e.g., a controller), a memory 122 (e.g., a storage unit), and a communication unit 123 (e.g., a network interface). The control unit 121 is, for example, a processor such as a CPU and a GPU. The control unit 121 controls the operation of each functional unit of the sheet post-processing apparatus 3. The control unit 121 executes various kinds of processing by loading and executing the program stored in the ROM in the RAM. The ASIC may have an appropriate function realized by the control unit 121.

The memory 122 is a memory that temporarily stores data used by each functional unit included in the sheet post-processing apparatus 3. The memory 122 stores, for example, a processing time and processing information (e.g., post-processing information) obtained by measurement. The memory 122 is, for example, a RAM. The communication unit 123 is a communication interface for transmitting and receiving data to and from an external apparatus. The communication unit 123 performs communication with the image forming apparatus 2, for example. The communication unit 123 receives binding information from the image forming apparatus 2.

The position selection button 13 is a button for selecting the position of the stapler 11 at the time of the binding using the manual stapling function. When the position selection button 13 is pressed by the user, the position of the stapler 11 is changed. Specifically, every time the position selection button 13 is pressed by the user, the sheet post-processing apparatus 3 moves the position of the stapler 11 at a predetermined interval.

The execution button 14 is a button for executing binding using the manual stapling function. When the execution button 14 is pressed by the user, the sheet post-processing apparatus 3 executes binding using the manual stapling function.

Next, the processing performed by the control unit 121 will be specifically described. The control unit 121 moves the stapler 11 and adjusts the angle of the stapler 11 so that the binding is performed at a position and an angle corresponding to an instruction input from the outside. Specifically, the control unit 121 moves the stapler 11 to a position corresponding to the input instruction by moving the moving mechanism capable of moving the position of the stapler. The control unit 121 adjusts the stapler 11 to an angle corresponding to the input instruction by rotating the rotating mechanism capable of adjusting the angle of the stapler 11 by rotating. The control unit 121 rotates the stapler 11 by rotating the rotating mechanism and adjusts the angle of the stapler 11 in a plurality of levels. The control unit 121 controls the moving mechanism to move the stapler 11 to a specified position input from outside.

When a two-binding-point instruction is input, the control unit 121 determines a position that is to be contrasted with a first position of a first point as a second position of a second point. Then, the control unit 121 controls the moving mechanism to move the stapler 11 to the determined first position and the determined second position in order. When a three-binding-point instruction is input, the control unit 121 determines a position that is to be contrasted with a first position of a first point as a second position of a second point. Next, the control unit 121 determines a position between the first position and the second position as a third position of a third point. The third position is, for example, an intermediate position between the first position and the second position. Then, the control unit 121 controls the moving mechanism to move the stapler 11 to the determined first position, the determined second position, and the determined third position in order.

Figure 3:
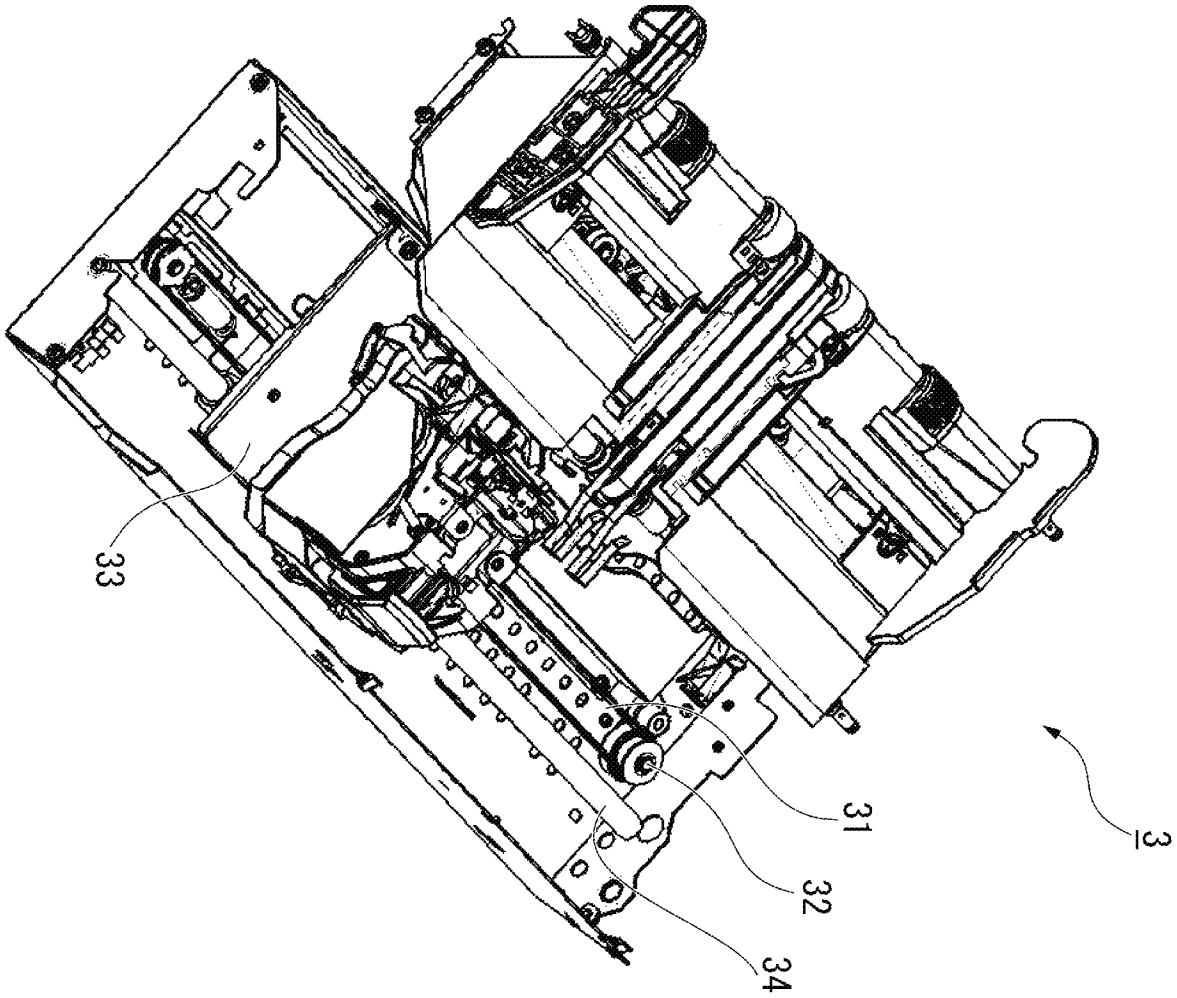
FIG. 3 is a diagram illustrating an internal mechanism in which a stapler of a sheet post-processing apparatus according to the embodiment is installed.
Figure 4:
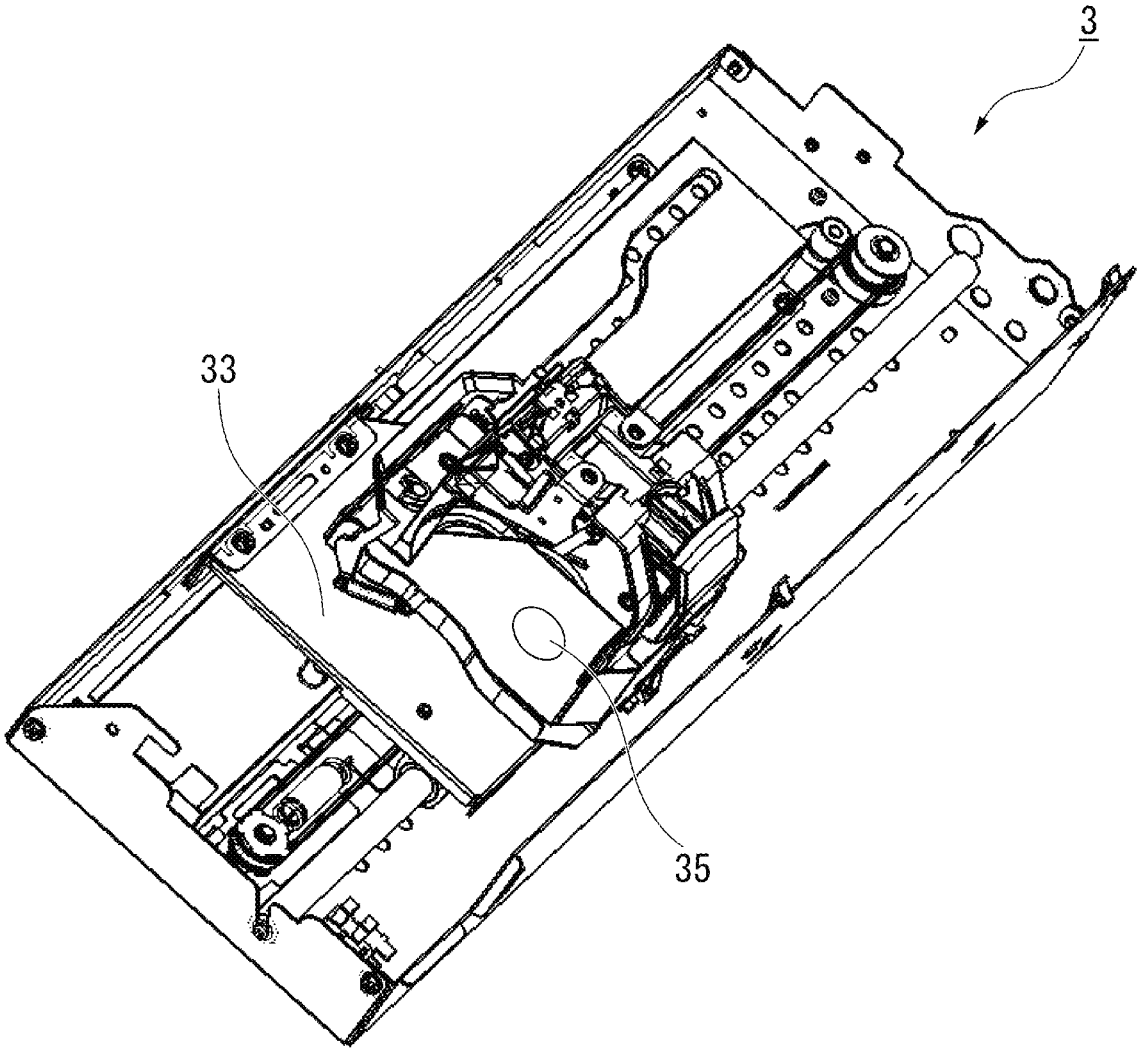
FIG. 4 is a diagram illustrating the internal mechanism in which the stapler of the sheet post-processing apparatus according to the embodiment is installed.

FIGS. 3 and 4 are diagrams illustrating an internal mechanism in which the stapler 11 of the sheet post-processing apparatus 3 according to the embodiment is installed. In FIGS. 3 and 4, the sheet post-processing apparatus 3 includes a belt 31, a motor 32, a stapling pedestal 33, a shaft 34, and a motor 35 therein. The belt 31 moves the stapling pedestal 33 in the horizontal direction by the rotation of the motor 32. The stapling pedestal 33 is a pedestal on which the stapler 11 is placed. The stapling pedestal 33 can be moved in the horizontal direction along the length of the shaft 34 by the rotation of the belt 31. By moving the stapling pedestal 33 in the horizontal direction, the stapler 11 can be moved to a position selected by the user. Here, the stapling pedestal 33 is an example of a moving mechanism (e.g., a translating actuator assembly or translating actuator) capable of moving the position of (e.g., translating) the stapler 11.

Further, the stapling pedestal 33 is provided with the motor 35. The motor 35 is a motor for rotating the stapler 11 around the yaw axis (i.e., the Z axis). For example, the motor 35 is provided between the stapling pedestal 33 and the stapler 11 and rotates the stapler 11 around the yaw axis. By the rotation of the motor 35, the stapler 11 can be adjusted to an angle selected by the user. Here, the motor 35 is an example of the rotating mechanism (e.g., a rotating actuator) provided on the moving mechanism and capable of adjusting the angle of the stapler 11 by rotating.

Figure 5:
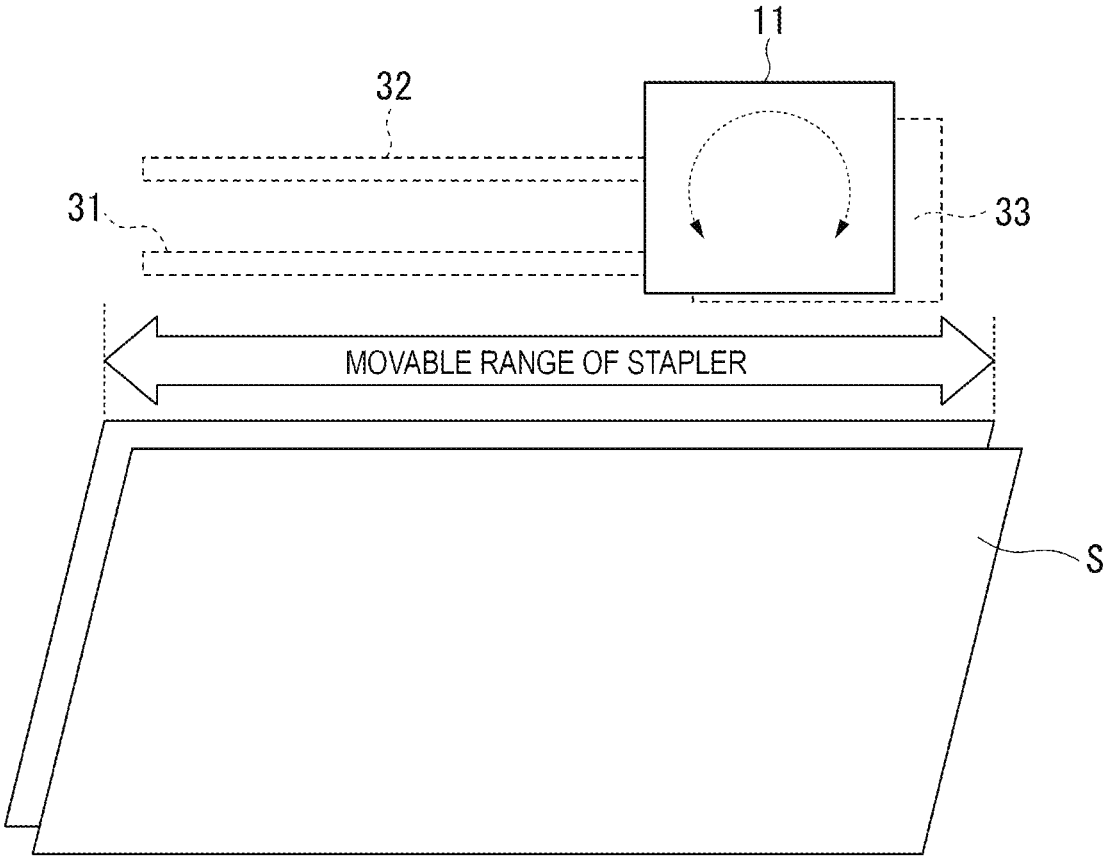
FIG. 5 is an explanatory diagram relating to adjustment of the stapler of the embodiment.

FIG. 5 is an explanatory diagram relating to adjustment of the stapler 11 of the embodiment. FIG. 5 illustrates an example in which a sheet S is inserted into the opening 15. As illustrated in FIG. 5, the stapler 11 can move in the longitudinal direction of the sheet S to a range where the binding can be performed by moving the stapling pedestal 33. Further, the stapler 11 can rotate to a range of ±90 degrees around the Z axis by rotation of the motor 35.

Figure 6:
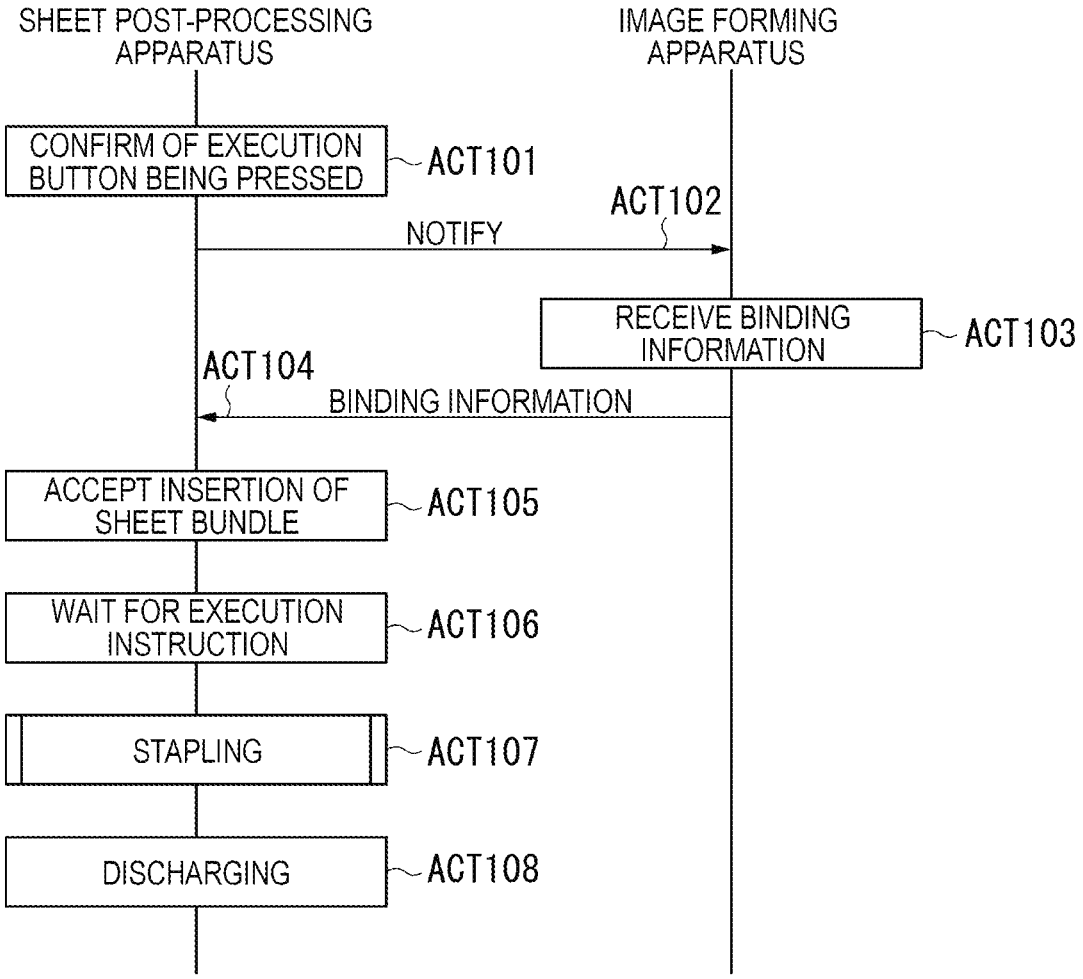
FIG. 6 is a sequence diagram illustrating a flow of processing of the image forming system according to the embodiment.

FIG. 6 is a sequence diagram illustrating a flow of processing of the image forming system 1 according to the embodiment. In FIG. 6, the binding using the manual stapling function will be described as an example. It is assumed that the user presses the execution button 14. When the user presses the execution button 14, the control unit 121 confirms that the user presses the execution button 14 (ACT 101). Then, the control unit 121 first sets the mode of the sheet post-processing apparatus 3 to a manual stapling mode. The manual stapling mode is a mode for executing the binding manually. Next, the control unit 121 controls the communication unit 123 to notify the image forming apparatus 2 that the execution button 14 is pressed (ACT 102).

The communication unit 53 of the image forming apparatus 2 receives the notification transmitted from the sheet post-processing apparatus 3. The control unit 51 causes the control panel 4 to display information on the binding according to the notification received by the communication unit 53. As a result, on the screen of the control panel 4, the information illustrated in FIG. 2 is displayed. Then, the image forming apparatus 2 receives the input of the binding information (ACT 103). When the input of the binding information is completed, the control unit 51 controls the communication unit 53 to transmit the input binding information to the sheet post-processing apparatus 3 (ACT 104). Completion of the input of the binding information may be determined by pressing an input completion button (not illustrated) displayed on the control panel 4.

The communication unit 123 of the sheet post-processing apparatus 3 receives the binding information transmitted from the image forming apparatus 2. The control unit 121 temporarily stores the binding information received by the communication unit 123 in the memory 122. Thereafter, the sheet post-processing apparatus 3 accepts insertion of a sheet bundle into the opening 15 (ACT 105). Then, the sheet post-processing apparatus 3 waits until the execution button 14 is pressed again (ACT 106). When the execution button 14 is pressed again, the control unit 121 executes the stapling based on the binding information temporarily stored in the memory 122 (ACT 107). The stapling is a process for controlling the stapler 11 to execute the binding. In the stapling, the binding is performed by adjusting the position, the angle, and the number of binding points of the stapler 11 based on the binding information. The specific stapling process will be described later. The sheet post-processing apparatus 3 discharges the sheet bundle on which the stapling is performed (ACT 108). When the stapling is completed, the control unit 121 deletes the binding information stored in the memory 122. Completion of the stapling may be determined based on the fact that the stapling is not performed any longer in the manual stapling mode.

Figure 7:
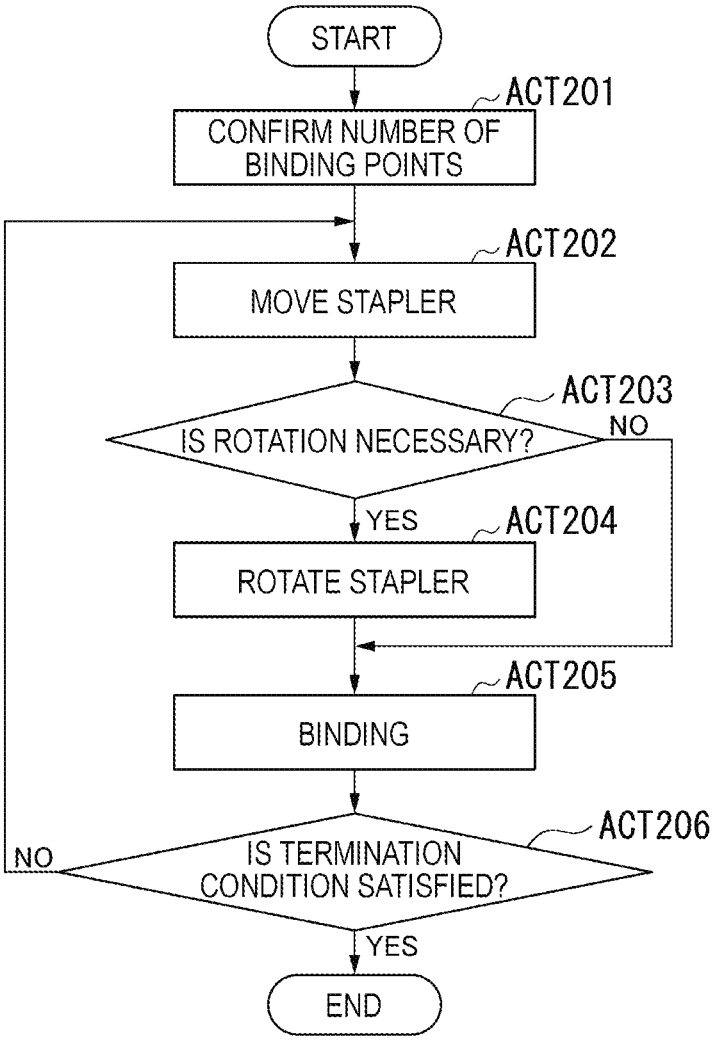
FIG. 7 is a flowchart illustrating a flow of stapling performed by the sheet post-processing apparatus according to the embodiment.

FIG. 7 is a flowchart illustrating a flow of stapling performed by the sheet post-processing apparatus 3 according to the embodiment. The control unit 121 confirms the number of binding points with reference to the binding information (ACT 201). For example, the control unit 121 confirms whether the desired quantity of binding points is "1 point", "2 points", or "3 points". Next, the control unit 121 moves the stapler 11 to the specified position by controlling the rotation of the motor 32 with reference to the binding information (ACT 202). Next, the control unit 121 determines whether or not rotation is necessary (ACT 203). If rotation is necessary (ACT 203: YES), the control unit 121 controls the rotation of the motor 35 to rotate the stapler 11 to a specified angle (ACT 204).

After the processing of ACT 204, or if rotation is not necessary (ACT 203: NO), the control unit 121 executes the binding (ACT 205). Specifically, the control unit 121 controls the stapler 11 to execute the binding. Thereafter, the control unit 121 determines whether or not a termination condition is satisfied (ACT 206). Here, the termination condition is a condition for terminating the stapling. For example, the termination condition may be that the user issues a termination instruction, or that all the instructions included in the binding information are executed. If the termination condition is satisfied (ACT 206: YES), the sheet post-processing apparatus 3 terminates the stapling.

When the termination condition is not satisfied (ACT 206: NO), the sheet post-processing apparatus 3 executes the processing after ACT 202. For example, when the number of binding points is two or more, the termination condition is not satisfied in the single processing of ACT 202 to ACT 205. Therefore, in such a case, the sheet post-processing apparatus 3 executes the processing after ACT 202.

First, the case where the number of binding points is two will be described. The control unit 121 determines a position that is to be contrasted with the first position of the first point as the second position of the second point. The control unit 121 controls the rotation of the motor 32 to move the stapler 11 to the determined second position. Thereafter, the control unit 121 executes the processing after the ACT 203.

Next, the case where the number of binding points is three will be described. The control unit 121 performs the same processing as in the case where the number of binding points is two up to the second point. Then, the control unit 121 determines a position between the first position and the second position as the third position of the third point. The control unit 121 controls the rotation of the motor 32 to move the stapler 11 to the determined third position. Thereafter, the control unit 121 executes the processing after the ACT 203.

Figure 8:
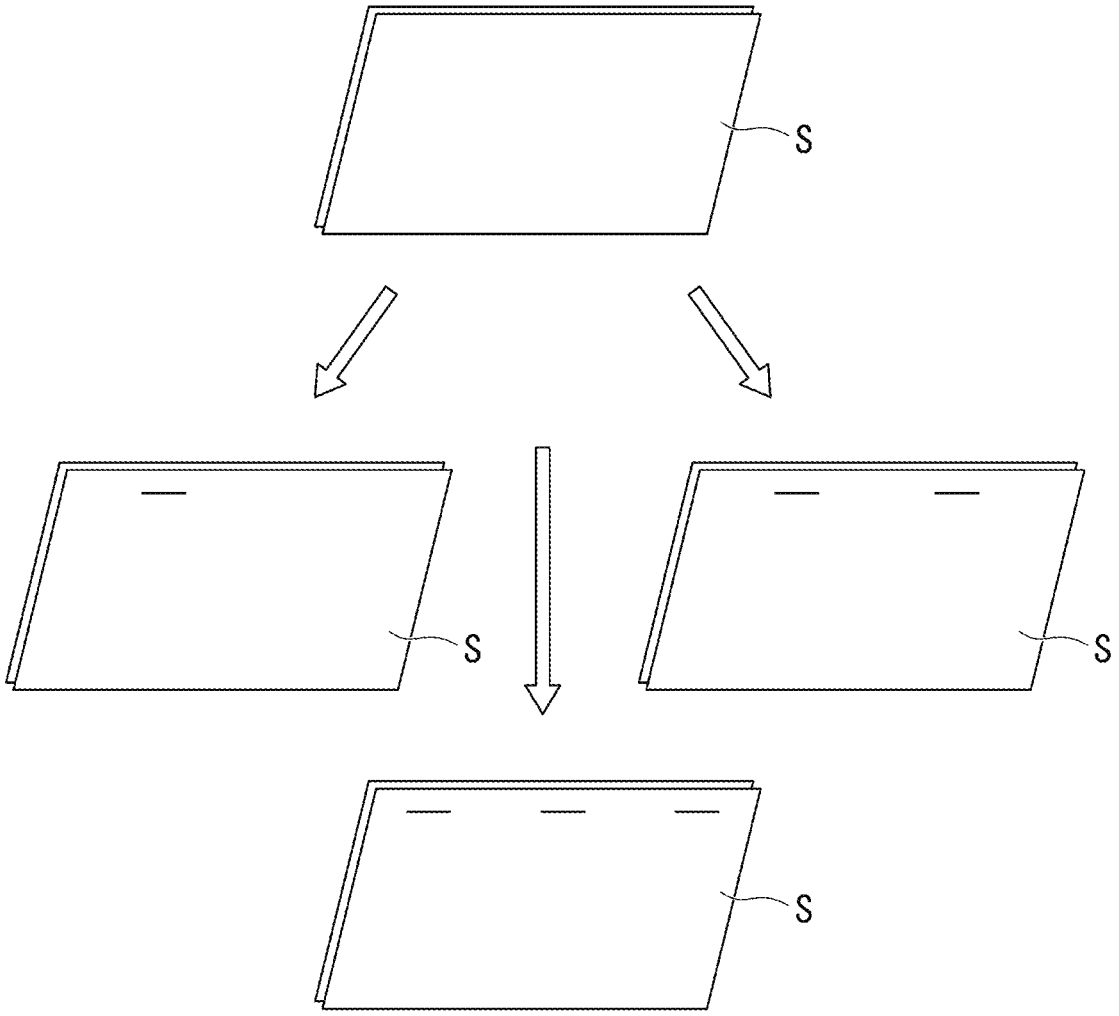
FIG. 8 is a diagram illustrating a result after stapling with different numbers of binding points is performed by the sheet post-processing apparatus according to the embodiment performs.
Figure 9:
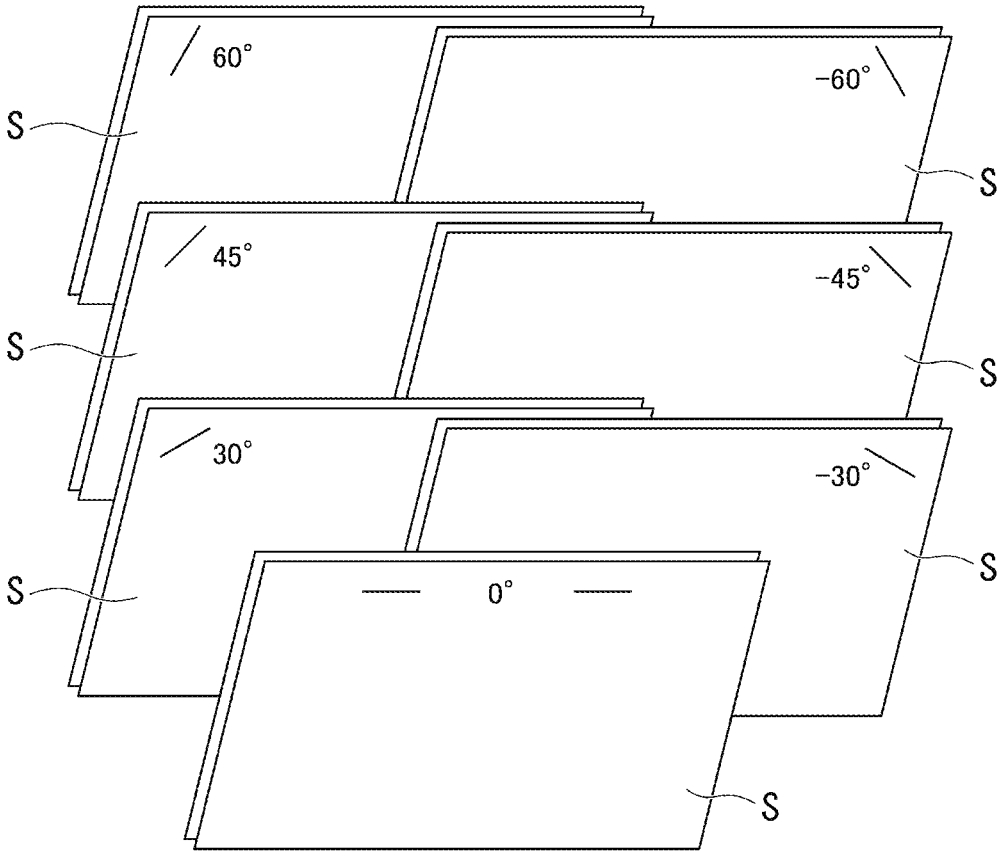
FIG. 9 is a diagram illustrating a result after stapling with different binding angles is performed by the sheet post-processing apparatus according to the embodiment.
Figure 10:
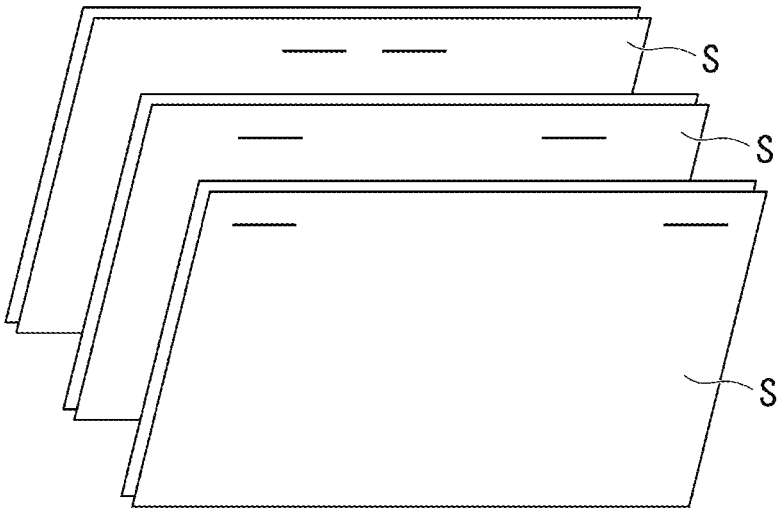
FIG. 10 is a diagram illustrating a result after stapling with different binding positions is performed by the sheet post-processing apparatus according to the embodiment.

Next, results after the stapling is performed by the sheet post-processing apparatus 3 according to the embodiment will be described with reference to FIGS. 8 to 10. FIG. 8 is a diagram illustrating a result after the stapling with different numbers of binding points is performed. FIG. 9 is a diagram illustrating a result after the stapling with different binding angles is performed. FIG. 10 is a diagram illustrating a result after the stapling with different binding positions is performed. By selecting the number of binding points, as illustrated in FIG. 8, stapling with different numbers of binding points can be performed on a plurality of sheets S. By selecting binding angles, as illustrated in FIG. 9, stapling with different binding angles can be performed on the plurality of sheets S. By selecting binding positions, as illustrated in FIG. 10, stapling with different binding positions can be performed on the plurality of sheets S.

According to the sheet post-processing apparatus 3 configured as described above, convenience can be improved. Specifically, the sheet post-processing apparatus 3 includes a moving mechanism capable of moving the position of the stapler 11, and a rotating mechanism capable of adjusting the angle of the stapler 11. Then, the sheet post-processing apparatus 3 controls the stapler so as to perform the binding at a position and an angle corresponding to an instruction input from the outside (e.g., a user input). Thereby, the binding can be executed not only at the fixed position and angle as in the related art, but also at the position and angle selected by the user. Therefore, convenience can be improved.

The sheet post-processing apparatus 3 rotates the stapler 11 and adjusts the angle of the stapler 11 in a plurality of levels by rotating the rotating mechanism (e.g., adjusts the angle of the stapler to a target angle selected from a predetermined list of target angles). For example, in the sheet post-processing apparatus 3, the binding angle can be adjusted in nine levels of (e.g., can be selected from a predetermined list of target angles including) "0 degrees", "±30 degrees", "±45 degrees", "±60 degrees", and "±90 degrees". As described above, the binding angle can be freely selected as compared with the related art. Therefore, convenience can be improved.

The sheet post-processing apparatus 3 controls the moving mechanism to move the stapler 11 to the specified position input from outside. For example, in the sheet post-processing apparatus 3, the binding position can be freely selected by the moving mechanism. Therefore, convenience can be improved.

Hereinafter, a modification example of the image forming apparatus 1 will be described. Depending on the instructed position or angle, the binding cannot be executed in some cases. Therefore, the control unit 121 determines whether or not the binding can be executed at each of the instructed position and angle. Then, the control unit 121 may be configured to output an error when the binding is not executable as a result of the determination. A specific example of a case where the binding is not executable is a case where the number of binding points is two or more and a binding angle other than 0 degrees is selected. In this example, the binding angle of 0 degrees may be considered the only allowable target angle.

In the present embodiment, the configuration is described in which an instruction regarding the position in the horizontal direction is input as the position of the stapler 11. On the other hand, an instruction regarding a depth (e.g., a vertical position) at the position of the stapler 11 may be input. In such a configuration, when an instruction regarding the depth is input, the control unit 121 controls the moving mechanism to move the stapler 11 in a depth direction (e.g., vertically to a target position). In this case, the sheet post-processing apparatus 3 is configured to be able to move the position of the member for aligning the sheet S in the depth direction. Then, the control unit 121 moves the member for aligning the sheet S to a specified depth direction.

In the above example, the number of binding points, the binding angle, and the binding position are selected by the control panel 4, but the present embodiment is not limited thereto. For example, when a job is transmitted from an information processing apparatus such as a personal computer, the number of binding points, the binding angle, and the binding position may be selected by a driver on the information processing apparatus.

Some functions of the image forming apparatus 2 and the sheet post-processing apparatus 3 in the above-described embodiment may be realized by a computer. In that case, a program for realizing these functions is recorded on a computer-readable recording medium. Then, the functions may be realized by causing a computer system to read and execute a program recorded on a recording medium in which the above-described program is recorded. The "computer system" referred to here includes hardware such as an operating system and peripheral equipment. In addition, "computer-readable recording medium" refers to a portable medium, a storage device, or the like. The portable medium is a flexible disk, magneto-optical disk, ROM, CD-ROM or the like. The storage device is a hard disk built in the computer system or the like. Further, the "computer-readable recording medium" dynamically holds a program for a short time, such as a communication line for transmitting a program via a communication line. The communication line is a network such as the Internet, a telephone line, or the like. The "computer-readable recording medium" may be a volatile memory inside a computer system serving as a server or a client. The volatile memory holds a program for a certain period of time. The above-described program may be for realizing a part of the above-described functions. The above-described program may be realized by combining the above-described functions with a program already recorded in the computer system.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a stapler configured to bind a plurality of sheets together;

a translating actuator configured to translate the stapler;

a rotating actuator coupled to the translating actuator and configured to rotate the stapler; and a controller configured to:

receive an instruction input;

determine a target position and a target angle of the stapler based on the instruction input;

control the translating actuator to move the stapler to the target position;

control the rotating actuator to rotate the stapler to the target angle; and control the stapler to bind the plurality of sheets together while the stapler is at the target position and the target angle.

2. The sheet processing apparatus of claim 1, wherein the controller is configured to determine the target angle of the stapler by selecting the target angle from a predetermined list of target angles based on the instruction input.

3. The sheet processing apparatus of claim 1, wherein the instruction input includes the target position.

4. The sheet processing apparatus of claim 1, wherein:

the target position is a first target position; and when the instruction input indicates that the plurality of sheets should be bound at two binding points, the controller is configured to:

determine a second target position of the stapler based on the instruction input;

control the translating actuator to move the stapler to the second target position; and control the stapler to bind the plurality of sheets together while the stapler is at the second target position and after binding the plurality of sheets together at the first target position.

5. The sheet processing apparatus of claim 1, wherein:

the target position is a first target position; and when the instruction input indicates that the plurality of sheets should be bound at three binding points, the controller is configured to:

determine a second target position and a third target position of the stapler based on the instruction input, the third target position being between the first target position and the second target position;

control the translating actuator to move the stapler to the second target position;

control the stapler to bind the plurality of sheets together while the stapler is at the second target position;

control the translating actuator to move the stapler to the third target position;

control the stapler to bind the plurality of sheets together while the stapler is at the third target position after binding the plurality of sheets together at the first target position and the second target position.

6. The sheet processing apparatus of claim 1, wherein the controller is configured to:

determine whether or not the stapler is capable of binding the plurality of sheets together while the stapler is at least one of (a) at the target position or (b) at the target angle; and output an error in response to at least one of (a) a determination that the stapler is not capable of binding the plurality of sheets together while the stapler is at the target position or (b) a determination that the stapler is not capable of binding the plurality of sheets together while the stapler is at the target angle.

7. The sheet processing apparatus of claim 1, wherein, in response to receiving an instruction regarding a depth at a position of the stapler, the controller is configured to control the translating actuator to move the stapler in a depth direction.

8. The sheet processing apparatus of claim 1, wherein the translating actuator is configured to move the stapler horizontally.

9. The sheet processing apparatus of claim 1, wherein the rotating actuator is coupled to the translating actuator such that the translating actuator is configured to move the rotating actuator.

10. An image forming system comprising:

a printer configured to print an image on a sheet, the printer including a user interface configured to receive a user input specifying at least one of (a) a location of a binding on the sheet, (b) an angle of the binding, or (c) a quantity of binding points where the sheet is bound; and a sheet processing apparatus comprising:

a stapler configured to form the at least one binding on the sheet;

an actuator configured to move the stapler relative to the sheet; and a controller configured to:

determine whether or not the stapler is capable of binding the sheet while the stapler is at least one of (a) at a target position or (b) at a target angle;

output an error in response to at least one of (a) a determination that the stapler is not capable of binding the sheet while the stapler is at the target position or (b) a determination that the stapler is not capable of binding the sheet while the stapler is at the target angle;

control the actuator to move the stapler to at least one of a target position or the target angle based on the user input; and control the stapler to bind the sheet.

11. The image forming system of claim 10, wherein:

the user input specifies the location of the binding on the sheet;

the actuator is a translating actuator configured to translate the stapler relative to the sheet; and the controller of the sheet processing apparatus is configured to:

control the translating actuator to translate the stapler to the target position based on the user input; and control the stapler to bind the sheet at the location of the binding specified by the user input.

12. The image forming system of claim 11, wherein:

the user input specifies the location and the angle of the binding on the sheet;

the sheet processing apparatus further comprises a rotating actuator configured to rotate the stapler relative to the sheet; and the controller of the sheet processing apparatus is configured to:

control the rotating actuator to rotate the stapler to the target angle based on the user input; and control the stapler to bind the sheet at the location and the angle of the binding specified by the user input.

13. The image forming system of claim 12, wherein:

the target position is a first target position;

the user input specifies the quantity of binding points where the sheet is bound; and in response to the quantity of binding points being greater than one, the controller of the sheet processing apparatus is configured to:

control the translating actuator to translate the stapler to a second target position; and control the stapler to bind the sheet while the stapler is at the second target position.

14. The image forming system of claim 10, wherein:

the user input specifies the angle of the binding on the sheet;

the actuator is a rotating actuator configured to rotate the stapler relative to the sheet; and the controller of the sheet processing apparatus is configured to:

control the rotating actuator to rotate the stapler to the target angle based on the user input; and control the stapler to bind the sheet at the angle of the binding specified by the user input.

15. The image forming system of claim 14, wherein:

the user input specifies the angle of the binding on the sheet and the quantity of binding points where the sheet is bound;

the sheet processing apparatus further comprises a translating actuator configured to translate the stapler relative to the sheet; and the controller of the sheet processing apparatus is configured to control the translating actuator to move the stapler according to the specified quantity of binding points.

16. The image forming system of claim 10, wherein:

the user input specifies the quantity of binding points where the sheet is bound; and the controller of the sheet processing apparatus is configured to control the actuator to move the stapler based on the specified quantity of binding points.

17. A sheet processing method comprising:

receiving a user input specifying at least one of (a) a location of a binding on a sheet, (b) an angle of the binding, or (c) a quantity of binding points where the sheet is bound;

determining a target position and a target angle of a stapler based on the user input;

in response to the user input specifying the angle of the binding and the quantity of binding points greater than one, determining whether or not the specified angle of the binding is allowable;

in response to a determination that the specified angle of the binding is not allowable, outputting an error; and in response to at least one of (a) the user input not specifying the angle of the binding, (b) the user input not specifying the quantity of binding points greater than one, or (c) a determination that the specified angle of the binding is allowable:

controlling a first actuator to move the stapler to the target position;

controlling a second actuator to rotate the stapler to the target angle; and controlling the stapler to bind the sheet at the target position and the target angle.

18. The sheet processing method of claim 17, wherein the target position is a first target position, further comprising, in response to the quantity of binding points specified by the user input being at least three:

controlling the first actuator to move the stapler to a second target position;

controlling the stapler to bind the sheet at the second target position;

controlling the first actuator to move the stapler to a third target position; and controlling the stapler to bind the sheet at the third target position after controlling the stapler to bind the sheet at the second target position.

* * * * *